US009019189B2

(12) United States Patent
Choi

(10) Patent No.: US 9,019,189 B2
(45) Date of Patent: Apr. 28, 2015

(54) IMAGE DISPLAY DEVICE AND DRIVING METHOD THEREOF THAT VARIES DRIVING FREQUENCY ACCORDING TO FREQUENCY OF DATA RECEIVED

(75) Inventor: Yong-Seok Choi, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 117 days.

(21) Appl. No.: 13/535,793

(22) Filed: Jun. 28, 2012

(65) Prior Publication Data

US 2013/0278569 A1 Oct. 24, 2013

(30) Foreign Application Priority Data

Apr. 24, 2012 (KR) ..... 10-2012-0042627

(51) Int. Cl.

*G09G 3/36* (2006.01)
*G09G 5/00* (2006.01)
*G09G 3/20* (2006.01)

(52) U.S. Cl.

CPC ..... *G09G 5/003* (2013.01); *G09G 3/20* (2013.01); *G09G 2320/103* (2013.01); *G09G 2330/021* (2013.01); *G09G 2340/0435* (2013.01); *G09G 2360/18* (2013.01)

(58) Field of Classification Search

CPC .. G09G 3/3648; G09G 3/3688; G09G 3/3611
USPC ..... 345/99, 204, 208, 211
See application file for complete search history.

(56) References Cited

U.S. PATENT DOCUMENTS

| | | | | |
|---|---|---|---|---|
| 2001/0003463 | A1* | 6/2001 | Tanimoto et al. | 347/235 |
| 2004/0189570 | A1* | 9/2004 | Selwan | 345/90 |
| 2006/0022929 | A1* | 2/2006 | Hashimoto et al. | 345/96 |
| 2008/0074369 | A1 | 3/2008 | Hsu | |
| 2008/0225062 | A1* | 9/2008 | Chang et al. | 345/691 |
| 2008/0309652 | A1 | 12/2008 | Ostlund | |
| 2009/0002307 | A1* | 1/2009 | Ino et al. | 345/98 |
| 2010/0085386 | A1* | 4/2010 | Lin et al. | 345/690 |
| 2010/0149414 | A1 | 6/2010 | Chen et al. | |
| 2011/0043551 | A1* | 2/2011 | Kikuta | 345/691 |
| 2012/0038618 | A1* | 2/2012 | Koyama | 345/212 |
| 2012/0063534 | A1* | 3/2012 | Lin et al. | 375/295 |

FOREIGN PATENT DOCUMENTS

| | | | |
|---|---|---|---|
| KR | 20030023973 | A | 3/2003 |
| KR | 10-2009-0069003 | A | 6/2009 |
| KR | 10-2009-0120359 | A | 11/2009 |
| KR | 10-2010-0050225 | A | 5/2010 |

* cited by examiner

*Primary Examiner* — Jonathan Blancha
(74) *Attorney, Agent, or Firm* — Robert E. Bushnell, Esq.

(57) ABSTRACT

Disclosed is an image display device capable of reducing power consumption and improving display quality. The image display device includes pixels disposed at portions at which scanning lines and data lines intersect with each other; a scanning driving unit driving the scanning lines; a data driving unit driving the data lines; a driving frequency selecting unit generating a selecting signal including information on a driving frequency using data supplied from an external system; and a timing controlling unit controlling the scanning driving unit and the data driving unit using the driving frequency included in the selecting signal.

20 Claims, 3 Drawing Sheets

IMAGE DISPLAY DEVICE AND DRIVING METHOD THEREOF THAT VARIES DRIVING FREQUENCY ACCORDING TO FREQUENCY OF DATA RECEIVED

CLAIM OF PRIORITY

This application makes reference to, incorporates the same herein, and claims all benefits accruing under 35 U.S.C. §119 from an application earlier filed in the Korean Intellectual Property Office on 24 Apr. 2012 and there duly assigned Serial No. 10-2012-0042627.

BACKGROUND OF THE INVENTION

1. Field of the Invention

An embodiment of the present invention relates to an image display device and a driving method thereof, and more particularly, to an image display device capable of reducing power consumption and improving display quality, and a driving method thereof.

2. Description of the Related Art

Recently, various display devices have been developed in order to reduce weight and volume of the display devices in comparison with cathode ray tubes. Among image display devices, there are liquid crystal display devices, field emission display devices, plasma display panels, organic light emitting display devices, and the like.

An image display device may be driven at a predetermined driving frequency. As an example, a image display device may be driven at a fixed driving frequency of 60 Hz or 120 Hz. In the case in which the driving frequency is fixed at a lower frequency (for example, 60 Hz), however, an after-image is generated due to motion blur, or the like. In addition, when the driving frequency is fixed to a higher frequency (for example, 120 Hz), a larger amount of power is consumed.

In order to overcome the above-mentioned problems, a method of analyzing a synchronizing signal (for example, Vsync or Hsync) to selectively adapt a driving frequency has been proposed. In the case of using the synchronizing signal to selectively adapt the driving frequency, however, the driving frequency is applied regardless of data signals, such that power is unnecessarily consumed.

SUMMARY OF THE INVENTION

An aspect of the present invention is to provide an image display device capable of reducing power consumption and improving display quality, and a driving method thereof.

In accordance with an embodiment of the present invention, an image display device may include pixels disposed at portions at which scanning lines and data lines intersect with each other; a scanning driving unit driving the scanning lines; a data driving unit driving the data lines; a driving frequency selecting unit generating a selecting signal including information on a driving frequency using data supplied from an external system; and a timing controlling unit controlling the scanning driving unit and the data driving unit using the driving frequency included in the selecting signal.

The driving frequency selecting unit may include a frame memory storing the data therein and supplying the stored data to the timing controlling unit; a measurer counting the number of supplies of the data supply for a predetermined time to generate a count value; and a determinator comparing the count value with a preset threshold to generate the selecting signal.

The measurer may include a first counter generating a reset signal every predetermined time; and a second counter counting the data to generate the count value and being initialized according to the reset signal.

The determinator may generate a selecting signal corresponding to a first driving frequency in the case in which the count value is smaller than the threshold and generates a selecting signal corresponding to a second driving frequency higher than the first driving frequency in other cases.

The determinator may generate the selecting signal so that the driving frequency stepwise increases from the first driving frequency to the second driving frequency.

The determinator may generate the selecting signal so that the driving frequency stepwise decreases from the second driving frequency to the first driving frequency.

The driving frequency selecting unit may further include a distributor supplying a control signal supplied from the external system to the timing controlling unit and supplying the data to the frame memory and the measurer. The external system does not supply the data in the case in which current data and previous data are the same as each other.

In accordance with another embodiment of the present invention, a driving method of an image display device may include steps of counting data supplied from an external system to generate a count value; comparing the count value with a preset threshold and generating a select signal including information on a driving frequency corresponding to a comparison result; and driving the image display device at the driving frequency included the selecting signal.

The data from the external system may be stored in and output from the frame memory.

The external system does not supply the data in the case in which current data and previous data are the same as each other. The count value may be determined corresponding to the number of supplies of the data supplied for a predetermined time.

In the generation of the selecting signal, a selecting signal corresponding to a first driving frequency may be generated in the case in which the count value is smaller than the threshold, and a selecting signal corresponding to a second driving frequency higher than the first driving frequency is generated in other cases.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
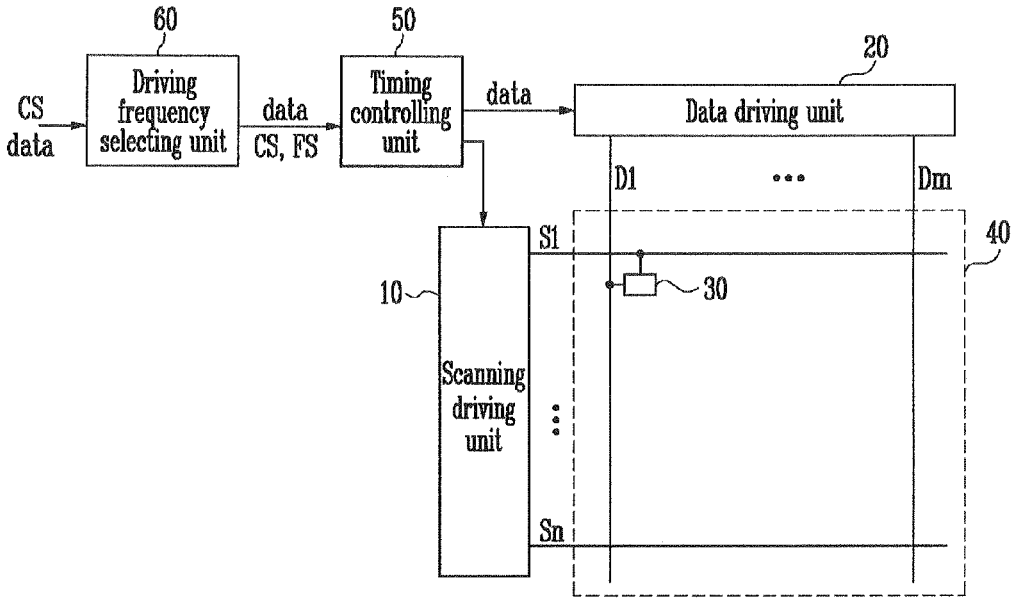
FIG. 1 is a view showing an image display device constructed with an embodiment of the present invention.

Hereinafter, certain embodiments of the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, exemplary embodiments will be described in detail with reference to the accompanying drawings so that they can be easily practiced by those skilled in the art to which the present invention pertains.

FIG. 1 is a view showing an image display device constructed with an embodiment of the present invention.

Referring to FIG. 1, the image display device constructed with an embodiment of the present invention may include a pixel unit 40 including pixels 30 disposed in areas defined by scanning lines S1 to Sn and data lines D1 to Dm; a scanning driving unit 10 driving the scanning lines S1 to Sn; a data driving unit 20 driving the data lines D1 to Dm; a timing controlling unit 50 controlling the scanning driving unit 10 and the data driving unit 20; and a driving frequency selecting unit 60 determining a driving frequency using data supplied from an external system.

The pixels 30 are disposed in portions at which the scanning lines S1 to Sn and data lines D1 to Dm intersect with each other. When scan signals are supplied to the pixels 30, the pixels 30 are selected to store voltage corresponding to data signals therein, and to generate light having a predetermined brightness corresponding to the stored voltage.

The scanning driving unit 10 supplies the scanning signals to the scanning lines S1 to Sn. For example, the scanning driving unit 10 may sequentially supply the scanning signals to the scanning lines S1 to Sn. In this case, the pixels 30 may be sequentially selected in a horizontal line unit.

The data driving unit 20 generates the data signals using the data supplied from the timing controlling unit 50. The data driving unit 20 generating the data signals supplies the data signals to the data lines D1 to Dm so as to be synchronized with the scanning signals. In this case, the data signals are supplied to the pixels 30 selected by the scanning signals.

The timing controlling unit 50 controls the scanning driving unit 10 and data driving unit 20. To this end, the timing controlling unit 50 receives a controlling signal CS, a selecting signal FS, and the data supplied from the driving frequency selecting unit 60. The timing controlling unit 50 receiving the selecting signal FS controls the scanning driving unit 10 and the data driving unit 20 such that the display device may be driven at the driving frequency included in the selecting signal FS. In addition, the timing controlling unit 50 supplies the data to the data driving unit 20 in correspondence with the driving frequency included in the selecting signal FS.

The driving frequency selecting unit 60 receives the controlling signal CS and the data supplied from the external system. The driving frequency selecting unit 60 receiving the data counts the data to select and determine the driving frequency and supplies the selecting signal FS representing the selected driving frequency to the timing controlling unit 50. In the case of determining the driving frequency using the data as described above, the driving frequency is automatically controlled, corresponding to a change in the data supplied from the external system, thereby making it possible to improve display quality and reduce power consumption. A detailed description thereof will be provided below.

Meanwhile, the controlling signal CS supplied from the external system may include various signals required for driving, for example, offset signals, gamma signals, display on/off signals, and sync signals. The driving frequency selecting unit 60 receiving the controlling signal CS transfers the controlling signal CS to the timing controlling unit 50.

Figure 2:
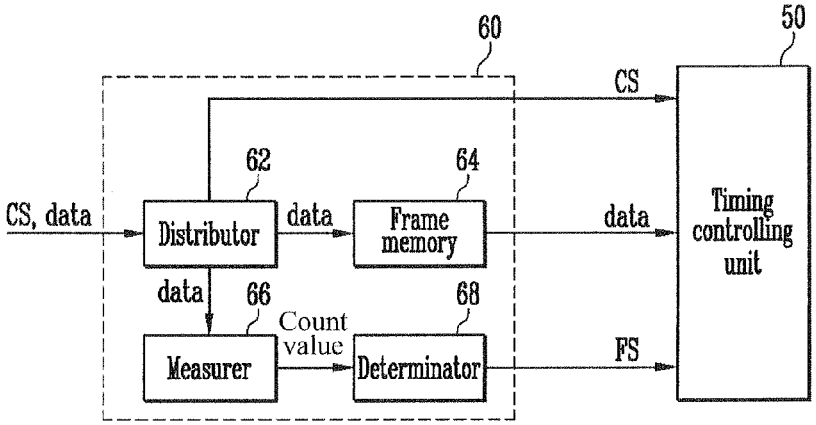
FIG. 2 is a view showing a driving frequency selecting unit constructed with an embodiment of the present invention shown in FIG. 1.

FIG. 2 is a view showing a driving frequency selecting unit constructed with an embodiment of the present invention shown in FIG. 1.

Referring to FIG. 2, the driving frequency selecting unit 60 constructed with the embodiment of the prevent invention includes a distributor 62, a frame memory 64, a measurer 66 and determinator 68.

The distributor 62 separates the controlling signal CS and the data supplied from the external system from each other. The controlling signal CS separated in the distributor 62 is supplied to the timing controlling unit 50 . In addition, the data separated in the distributor 62 is supplied to the frame memory 64 and to the measurer 66. Meanwhile, in the case in which the controlling signal CS and the data are transmitted from the external system to the same interface, the distributor 62, which separates the controlling signal CS and the data from each other, may be omitted corresponding to a transmission method of the external system. As an example, the controlling signal CS may be directly supplied from the external system to the timing controlling unit 50, and the data may be directly supplied from the external system to the frame memory 64 and the measurer 66.

The frame memory 64 stores the data by one frame supplied from the distributor 62 therein and supplies the stored data to the timing controlling unit 50. Meanwhile, in the case in which the frame memory 64 is provided, the external system does not repeatedly supply the same data.

More specifically, the frame memory 64 stores the data by one frame. Accordingly, the external system does not supply a separate data to the distributor 62 in the case in which the previous data and current data are the same as each other. For example, when a still image is displayed for a predetermined period, after the data corresponding to the still image is stored in the frame memory 64, the external system does not supply the separate data to the distributor 62 for a predetermined period. In addition, in the case in which a moving picture is displayed for a predetermined period, the external system continuously supplies the data corresponding to the moving picture to the distributor 62 for a predetermined period.

The measurer 66 counts the data supplied from the distributor 62 for a predetermined time to generate a count value and supplies the generated count value to the determinator 68.

The determinator 68 compares the count value with a threshold and supplies the selecting signal FS corresponding to the comparison result to the timing controlling unit 50.

Figure 3:
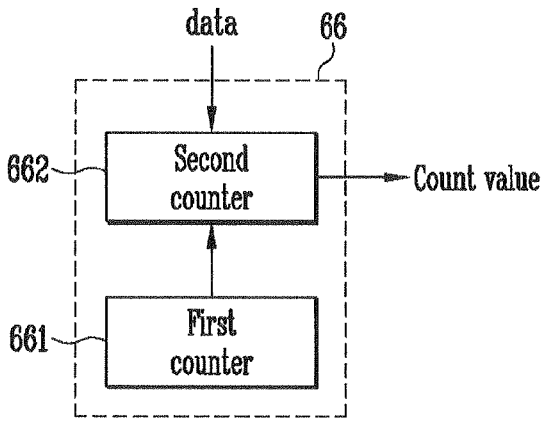
FIG. 3 is a view showing a measurer constructed with the embodiment of the present invention shown in FIG. 2.

FIG. 3 is a view showing a measurer 66 constructed with another embodiment of the present invention shown in FIG. 2.

Referring FIG. 3, the measurer 66 includes a first counter 661 and a second counter 662.

The first counter 661 generates a reset signal every predetermined time, supplies the generated reset signal to the second counter 662.

The second counter 662 counts the data for a predetermined time to generate a count value and supplies the generated count value to the determinator 68. In addition, the second counter 662 is initialized by the reset signal supplied from the first counter 661.

Meanwhile, a predetermined time which becomes a generation reference of the reset signal in the first counter 662 is set in advance in consideration of the size, the display resolution, and the like, of a panel. As an example, a predetermined time may be set to one (1 ) vertical period Vsync.

Figure 4:
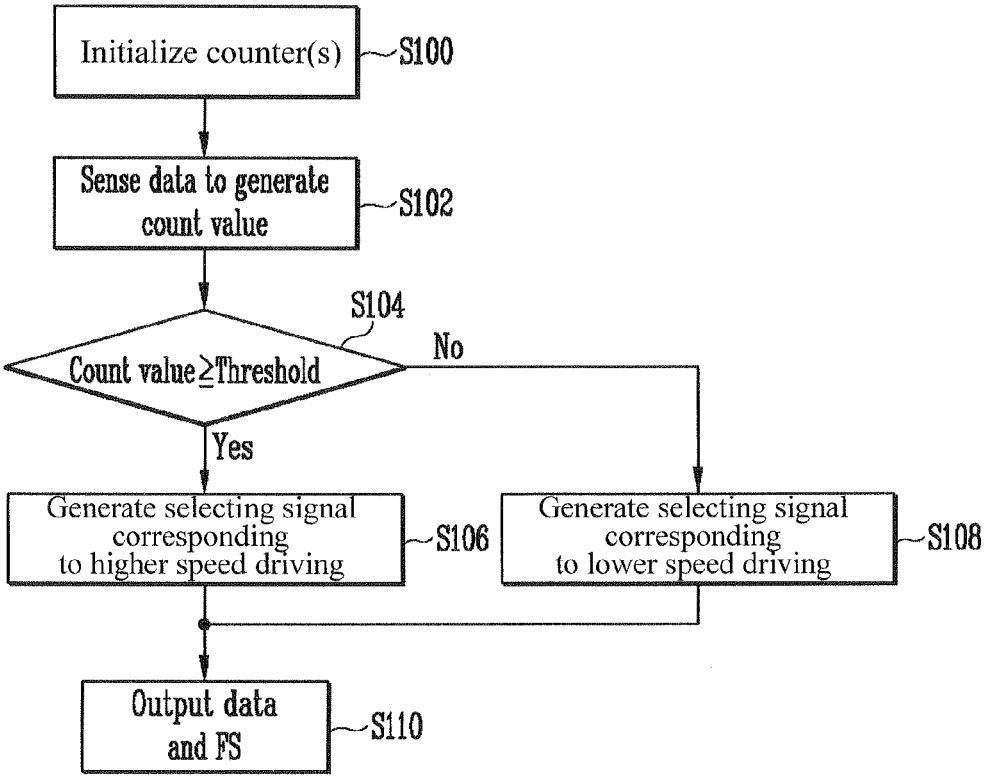
FIG. 4 is a flow chart showing an operation process of the driving frequency selecting unit shown in FIG. 2.

FIG. 4 is a flow chart showing an example of an operation process of the driving frequency selecting unit shown in FIG. 2.

In reference to FIG. 4, counters included in the measurer 66 are initialized (S100). As one example, the counters may be reset zero.

After the counters are initialized in operation (S100), data are supplied from the distributor 62 to the measurer 66.

The measurer 66 counts the data for a predetermined time to generate a count value (S102). In this case, the count value increases corresponding to the number of supplies of the data supplied for a predetermined time.

The count value generated in the measurer 66 is supplied to the determinator 68. The determinator 68 compares the count value with a preset threshold (S104). Here, the threshold, which is a value compared with the count value to select a first driving frequency (for example, 60 Hz) or a second driving frequency (for example, 120 Hz), is preset in advance in consideration of the size, the display resolution, and the like, of a panel. For example, the threshold may be set to "60".

In the case in which it is determined in operation S104 that the count value is equal to or higher than the threshold, the determinator 68 generates a selecting signal FS corresponding to the higher speed driving, that is, the second driving frequency (S106). On the other hand, in the case in which it is determined in operation S104 that the count value is smaller than the threshold, the determinator 68 generates a selecting signal FS corresponding to, the lower speed driving, that is, the first driving frequency (S110).

The selecting signal FS generated by the determinator 68 is supplied to the timing controlling unit 50. In addition, the data stored in the frame memory 64 is supplied together with the selecting signal FS to the timing controlling unit 50 (S110). Actually, the driving frequency selecting unit 60 according to the present invention selects the driving frequency using the data supplied from an external system while repeating the above-mentioned process.

Meanwhile, in accordance with the present invention, since the driving frequency is determined using the data, the power consumption may be reduced. More specifically, in the case in which a still image is displayed, the determinator 68 outputs the selecting signal FS corresponding to the first driving frequency regardless of sync signals Hsync and Vsync. Therefore, in the case in which the still image is displayed, since the image display device may be driven at a lower frequency, the power consumption may be reduced.

In addition, in accordance with the present invention, the driving frequency may be automatically controlled corresponding to the number of supplies of the data from the external system.

Meanwhile, although the case in which the selecting signal FS corresponds to any one of the first driving frequency and second driving frequency has been described above, the present invention is not limited thereto. For example, in the case in which the driving frequency is changed from the first driving frequency to the second driving frequency, corresponding to a result of the measurer 66, the determinator 68 may generate the selecting signal FS so that the driving frequency increases in a stepwise fashion. The selecting signal FS may be generated so that the driving frequency is changed to sequentially be 60 Hz, 70 Hz, 80 Hz, . . . , 120 Hz. Therefore, deterioration of image quality due to a rapid change in the driving frequency may be prevented.

Likewise, in the case in which the driving frequency is changed from the second driving frequency to the first driving frequency, the determinator 68 may generate the selecting signal FS so that the driving frequency decreases in a step wise fashion. For example, the selecting signal FS may be generated so that the driving frequency is changed to sequentially be 120 Hz, 110 Hz, 100 Hz, . . . , 60 Hz. Therefore, deterioration of image quality due to a rapid change in the driving frequency may be prevented.

Figure 5:
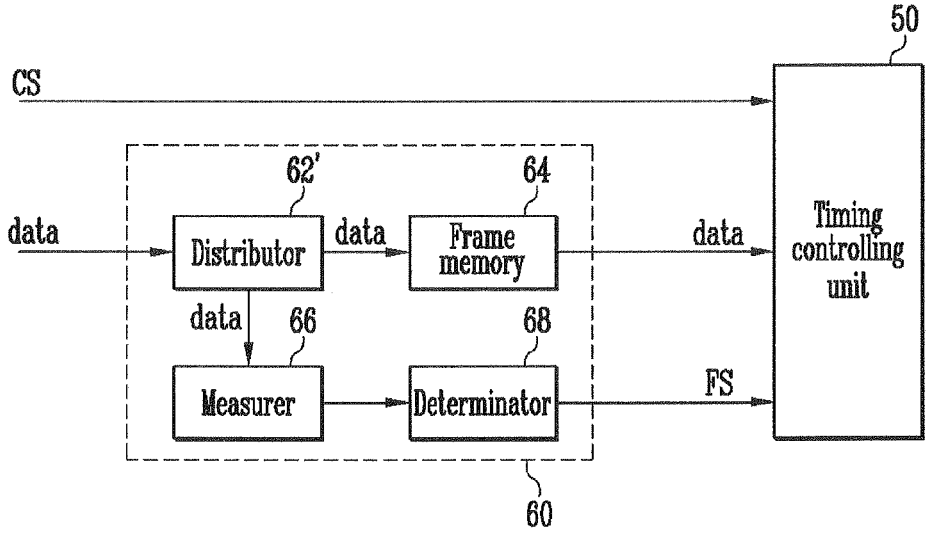
FIG. 5 is a view showing a driving frequency selecting unit constructed with another embodiment of the present invention shown in FIG. 1.

FIG. 5 is a view showing a driving frequency selecting unit 60 constructed with a second exemplary embodiment of the present invention shown in FIG. 1. In FIG. 5, the same reference numerals will be used to describe the same components as those of FIG. 2. In addition, a detailed description of the same components as those of FIG. 2 will be omitted.

In reference to FIG. 5, a controlling signal CS is supplied directly from an external system to the timing controlling unit 50, and data is supplied from the external system to a distributor 62'. In this case, the distributor 62' supplies the data from the external system to the frame memory 64 and the measurer 66.

Meanwhile, in accordance with the present invention, the distributor 62' may also be omitted. In this case, the data from the external system is supplied directly to the frame memory 64 and measurer 66.

As set forth above, with the image display device and the driving method thereof according to the exemplary embodiments of the present invention, since the driving frequency is determined by counting the data, the image display device is driven at a low frequency regardless of the synchronizing signal in the case of implementing a still image, or the like, thereby making it possible to minimize the power consumption. In addition, according to the exemplary embodiments of the present invention, since the driving frequency is determined using the data, the driving frequency may be automatically selected, corresponding to the number of data supplies.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An image display device, comprising:

pixels disposed at portions at which scanning lines and data lines intersect with each other;

a scanning driving unit driving the scanning lines;

a data driving unit driving the data lines;

a driving frame frequency selecting unit generating a selecting signal including information on a driving frame frequency based upon a number of frames of image data supplied from an external system within a predetermined time period, wherein the external system does not supply the image data in the case in which current image data and previous image data are the same as each other; and a timing controlling unit controlling the scanning driving unit and the data driving unit according to the driving frame frequency included in the selecting signal, wherein the driving frame frequency selecting unit to generate a first selecting signal to drive the image display device at a first driving frame frequency corresponding to a relatively still image being displayed upon the number of frames of image data supplied from the external system within the predetermined period of time being less than a preset threshold, and the driving frame frequency selecting unit to generate a second selecting signal to drive the image display device at a second and higher driving frame frequency corresponding to a moving picture being displayed upon the number of frames of data supplied from the external system within the predetermined period of time being equal to or greater than the preset threshold.

2. The image display device of claim 1, wherein the driving frame frequency selecting unit includes:

a frame memory storing the image data and supplying the stored image data to the timing controlling unit;

a measurer generating a count value by counting the number of frames of the image data supplied during the predetermined time period; and a determinator comparing the count value with a preset threshold and generating the selecting signal in dependence upon the comparison result between the count value and the preset threshold.

3. The image display device of claim 2, wherein the measurer includes:

a first counter generating a reset signal every predetermined time period; and a second counter generating the count value, the second counter being initialized in accordance with the reset signal.

4. The image display device of claim 2, wherein the determinator generates the first selecting signal corresponding to the first driving frame frequency in the case corresponding to the still image being displayed where the count value is smaller than the preset threshold, and the determinator generates the second selecting signal corresponding to the second driving frame frequency higher than the first driving frame frequency in the case corresponding to the moving picture being displayed where the count value is equal to or greater than the preset threshold.

5. The image display device of claim 4, wherein the determinator generates the selecting signal so that the driving frame frequency increases in a stepwise fashion in the case in which the driving frame frequency is changed from the first driving frame frequency to the second driving frame frequency.

6. The image display device of claim 4, wherein the determinator generates the selecting signal so that the driving frame frequency decreases in a stepwise fashion in the case in which the driving frame frequency is changed from the second driving frame frequency to the first driving frame frequency.

7. The image display device of claim 2, wherein the preset threshold is greater than unity.

8. The image display device of claim 1, wherein the external system is external to each of the pixels, the scanning driving unit, the data driving unit, the driving frame frequency selecting unit and the timing controlling unit.

9. The image display device of claim 1, the number of frames of image data supplied from the external system within the predetermined period of time is equal to a number of supplies of image data from the external system within the predetermined period of time.

10. A driving method of an image display device, comprising:

generating a count value by counting a number of frames of image data supplied from an external system within a predetermined time period, wherein the external system does not supply the image data in the case in which current image data and previous image data are the same as each other;

generating a comparison result by comparing the count value with a preset threshold;

generating a selecting signal including information on a driving frame frequency based upon the comparison result between the count value and the preset threshold; and driving the image display device at the driving frame frequency included in the selecting signal, wherein the generating of the selecting signal comprises:

generating a first selecting signal to drive the image display device at a first driving frame frequency corresponding to a relatively still image being displayed upon the count value being less than the preset threshold; and generating a second selecting signal to drive the image display device at a second and higher driving frame frequency corresponding to a moving picture being displayed upon the count value being equal to or greater than the preset threshold.

11. The method of claim 10, wherein the frames of image data from the external system are stored in and output from the frame memory.

12. The method of claim 10, further comprising generating the selecting signal so that a driving frame frequency increases in a stepwise fashion in the case in which the driving frame frequency is changed from the first driving frame frequency to the second driving frame frequency.

13. The method of claim 10, further comprising generating the selecting signal so that a driving frame frequency decreases in a stepwise fashion in the case in which the driving frame frequency is changed from the second driving frame frequency to the first driving frame frequency.

14. The method of claim 10, wherein the driving frame frequency is determined independently of synchronizing signals Vsync and Hsync.

15. The method of claim 10, wherein the preset threshold is greater than unity.

16. An image display device, comprising:

a plurality of pixels, each pixel being electrically connected to scanning lines and data lines;

a scanning driving unit driving the scanning lines;

a data driving unit driving the data lines;

a driving frame frequency selecting unit receiving frames of image data from an external system, determining a driving frame frequency driving the image display device, and generating a selecting signal representing the driving frame frequency, wherein the external system does not supply any frames of image data when the current image data and previous image data are the same, wherein the determined driving frame frequency is based upon whether or not a number of times frames of the image data are received from the external system within a predetermined period of time excedes a preset threshold; and a timing controlling unit receiving the selecting signal and controlling the scanning driving unit and the data driving unit according to the generated selecting signal, wherein the driving frame frequency selecting unit to generate a first selecting signal to drive the image display device at a first driving frame frequency corresponding to a relatively still image being displayed upon the number of times frames of image data is supplied from the external system within the predetermined period of time being less than a preset threshold, and the driving frame frequency selecting unit to generate a second selecting signal to drive the image display device at a second and higher driving frame frequency corresponding to a moving picture being displayed upon the number of times frames of image data are supplied from the external system within the predetermined period of time being equal to or greater than the preset threshold.

17. The image display device of claim 16, wherein the driving frame frequency selecting unit includes:

a measurer generating a count value by counting the number of times frames of image data are supplied within the predetermined time period; and a determinator comparing the count value with the preset threshold and generating the selecting signal based upon the comparison result between the count value and the preset threshold.

18. The image display device of claim 17, wherein the determinator generates the first selecting signal corresponding to the first driving frame frequency in the case corresponding to the still image being displayed where the count value is smaller than the preset threshold, and the determinator generates the second selecting signal corresponding to the second driving frame frequency higher than the first driving frame frequency in the case corresponding to the moving picture being displayed where the count value is equal to or greater than the preset threshold.

19. The image display device of claim 16, wherein the preset threshold is greater than unity.

20. The image display device of claim 16 the external system being external to each of the pixels, the scanning driving unit, the data driving unit, the driving frame frequency selecting unit and the timing controlling unit.

* * * * *